United States Patent [19]

Harrell

[11] 3,998,703

[45] Dec. 21, 1976

[54] METHOD OF TREATING MATERIALS ON A ROTARY HEARTH

[75] Inventor: John B. Harrell, Pittsburgh, Pa.

[73] Assignee: Salem Corporation, Pittsburgh, Pa.

[22] Filed: Feb. 6, 1975

[21] Appl. No.: 547,628

[52] U.S. Cl. ..... 201/32; 201/27; 201/40; 202/117; 202/136; 202/133; 432/137; 432/138; 432/139; 432/239; 432/124; 110/35; 110/36; 266/105; 266/257

[51] Int. Cl.[2] ..... C10B 47/20; C10B 7/00

[58] Field of Search ..... 201/32, 27, 40; 202/117, 136, 133; 266/5 R, 5 B, 21, 18; 432/137, 138, 139, 239, 124; 110/35, 36

[56] References Cited

UNITED STATES PATENTS

| | | | |
|---|---|---|---|
| 3,470,068 | 9/1969 | Kemmerer, Jr. et al. | 202/117 X |
| 3,594,286 | 7/1971 | Kemmerer, Jr. | 202/117 X |

FOREIGN PATENTS OR APPLICATIONS

| | | | |
|---|---|---|---|
| 739,651 | 10/1943 | Germany | 110/36 |
| 3,287 | 2/1910 | United Kingdom | 110/36 |

*Primary Examiner*—James H. Tayman, Jr.
*Attorney, Agent, or Firm*—Frank P. Cyr

[57] ABSTRACT

The invention relates to a method and apparatus for the heat treatment of materials on a traveling hearth mounted on a horizontal plane and rotated on a vertical axis within a substantially air-tight enclosure. The materials on the hearth are deposited thereon in separate and distinct rows and retained in separate rows while undergoing heat treatment within the enclosure. The material in one of said rows is capable of evolving volatiles when the materials are subjected to a heat treatment and the evolved volatiles rise and are dispersed in the upper portion of the enclosure where the same will combine with an oxidant such as air and/or oxygen which is admitted into this portion of the enclosure. The mixture of evolved volatiles and oxidants such as air and/or oxygen will combust in the upper portion of the enclosure. The heat created by the combustion of the evolved volatiles is directed onto the roof and side walls of the enclosure thence transferred back onto the materials which are in other spaced apart rows on the hearth to thus heat treat these materials. The materials to be heat treated by the combustion of the volatiles emanating from the said one row of materials may be granular, solid, or liquid as the case may be.

11 Claims, 9 Drawing Figures

METHOD OF TREATING MATERIALS ON A ROTARY HEARTH

BACKGROUND OF THE INVENTION

The heat treatment of materials within a substantially air-tight enclosure is not entirely new as evidenced by the disclosure of Asquini Pat. No. 3,227,627, as well as in the disclosure of Kemmerer and Buschow Pat. No. 3,475,286. However, in both of the aforementioned patents, no provision is made for the feed of materials onto the hearth in separate and distinct rows and retained in separate and spaced apart rows throughout the time the materials are subjected to a heat treatment within the enclosure.

Thus, with the above in mind, it is the primary object of the invention to provide a means whereby materials or substances capable of evolving volatiles when subjected to a heat treatment are fed onto a horizontally disposed traveling hearth and retained in a separate and distinct row from the time of entry into the enclosure until the removal thereof from onto the hearth while simultaneously maintaining separate and spaced apart rows of non-volatile or essentially non-volatile containing materials or substances on the hearth and whereby the heat created by the combustion of the evolved volatiles from said one row of materials is utilized to heat treat the non-volatile or essentially non-volatile containing materials or substances which are also on the hearth but which have been deposited thereon in separate and spaced apart rows and retained in spaced apart rows while the materials are undergoing heat treatment within the enclosure.

Another object of the invention is to provide spaced apart feed chutes for the deposit of both volatile and non-volatile or essentially non-volatile containing materials or substances onto the hearth in spaced apart rows and retained in such spaced apart rows during the time the materials or substances are subjected to a heat treatment within an enclosure.

Another object of the invention is to form a traveling hearth in separate sections said sections extending on the same horizontal plane and mounted on suitable supporting means to thus permit for each section of the hearth to be separately driven by any suitable power means thus enabling the sections to be rotated at differing speeds and/or driven in opposite directions in order to properly process the materials or substances deposited onto the separate sections of the hearth.

Another object of the invention is to provide a plurality of sets of rabbles mounted in the roof of the enclosure, each set of rabbles designed to extend to a position closely adjacent to the floor of the hearth and so positioned in the roof of the enclosure as to permit each set of rabbles to engage with the spaced apart rows of materials or substances on the hearth to turn over the materials and to simultaneously direct the same to suitable discharge exits formed in the enclosure.

Another object of the invention is to provide a recessed area or well on the hearth to receive therein a suitable volatile evolving material such as oil, or the like.

Another object of the invention is to provide a means whereby objects to be heat treated within an enclosure are arranged in staggered relationship and in separate and spaced apart rows so as to permit for the objects to be charged into the enclosure and removed from therewithin by any suitable mechanism such as a pusher arm or the like which can be power operated to effect the placement of objects within the enclosure and to effect the removal of the objects from within the enclosure following the proper heat treatment of the objects within the enclosure.

These, together with the various ancillary objects and features of the invention, which will become apparent as the following description proceeds, are attained by this method and apparatus, preferred embodiments of which are illustrated in the accompanying drawings, by way of example only, wherein:

DESCRIPTION OF THE PREFERRED EMBODIMENTS

Figure 1:
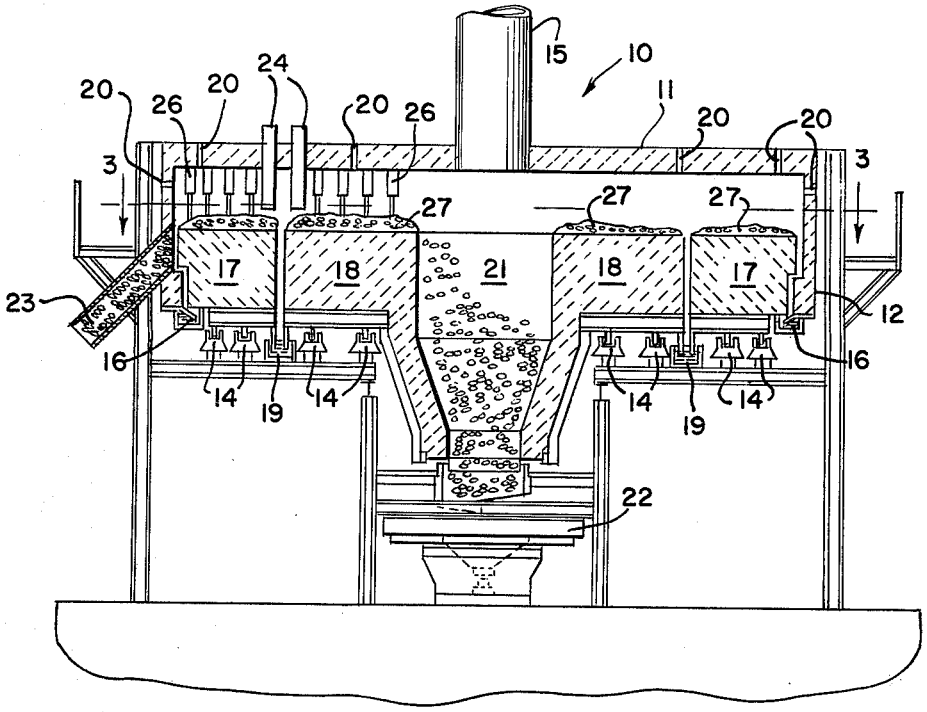
FIG. 1 is a cross secional view of the enclosure of the present invention, showing a sectional hearth.

Before undertaking a detailed explanation of the various aspects of the inventive concept herein, it is pointed out that the essence of the present invention is the fact that a single enclosure having a traveling hearth mounted for rotation therein can be utilized for the heat treatment therein of different substances or objects which are deposited on the hearth in separate and spaced apart concentric rows. One row of materials or objects comprises a volatile-containing material or object whereas the other row or rows of materials or objects may be devoid or substantially devoid of volatiles therein. The volatile-containing substances or objects are subjected to a heat treatment within the enclosure. Also, the materials or substances to be subjected to a heat treatment within the enclosure may be granular, solid or liquid objects, such as steel ingots, and the like, the only requirement being that at least one of the materials or objects deposited on the hearth contain sufficient volatiles therein which will evolve therefrom when subjected to a heat treatment and combust within the enclosure so as to generate therein some of or all of the heat necessary to properly process the other materials or objects which have been deposited on the hearth in spaced apart rows.

Referring now to the drawings there is shown therein a furnace enclosure designated generally by reference numeral 10. The enclosure comprises a stationary roof 11 and side walls 12 made of a suitable refractory material to withstand the heat generated within the enclosure. The hearth 13 shown in FIG. 2 comprises a unitary structure mounted for rotation on a vertical axis by suitable rollers 14 which are supported in any known manner on a framework utilized for maintaining the enclosure and associated parts in operating position. A flue 15 is formed in the roof 11 for the exit of waste gases from within the enclosure. Conventional seals such as a sand or water containing trough 16 extends between the horizontally disposed rotating hearth 13 and the stationary side walls 12 of FIG. 2 to prevent the exit of heat and gases from within the enclosure. Shown in FIG. 1 of the drawings is a two-part hearth floor shown by reference numerals 17 and 18. The hearth sections shown in FIG. 1 of the drawings are also disposed on the same horizontal plane and are mounted for rotation on sets of rollers 14 and in addition to having the seals 16 mounted between the rotary hearth and the stationary side walls 12, a similar seal 19 extends between the hearth sections 17 and 18, again to prevent the exit of heat and gases from within the enclosure.

Ports 20 are formed in the side walls and roof of the enclosure for admitting an oxidant such as air and/or oxygen within the enclosure for a purpose to be explained more fully hereinafter. Formed centrally of the hearth shown in FIGS. 1 and 2 of the drawings is a central discharge area 21 which leads to a suitable receiver means indicated generally at 22 which can be in the nature of a rotating table and a suitable stationary blade positioned thereover will engage with the materials thereon and direct the same outwardly from thereon to a suitable receiver means. A side exit 23 extends from an opening formed in the side walls 12 for directing processed materials onto a suitable receiver means, not shown.

Extending through the roof of the enclosure and supported thereby in any known manner are spaced apart feed chutes 24, which will deposit materials or substances on the floor of the hearth. The depth of deposit of materials on the hearth may be varied by adjusting the height of the exit end of the chutes with respect to the floor surface of the hearth. Also mounted in any known manner in the roof of the enclosure are sets of rabbles 26. The sets of rabbles are so disposed about the floor of the hearth as to engage with the materials 27 deposited thereon through the chutes 24 and to turn over the materials and simultaneously progressively advance the same to the aforesaid exit openings. As shown, there is provided one set of rabbles for each chute 24.

Figure 2:
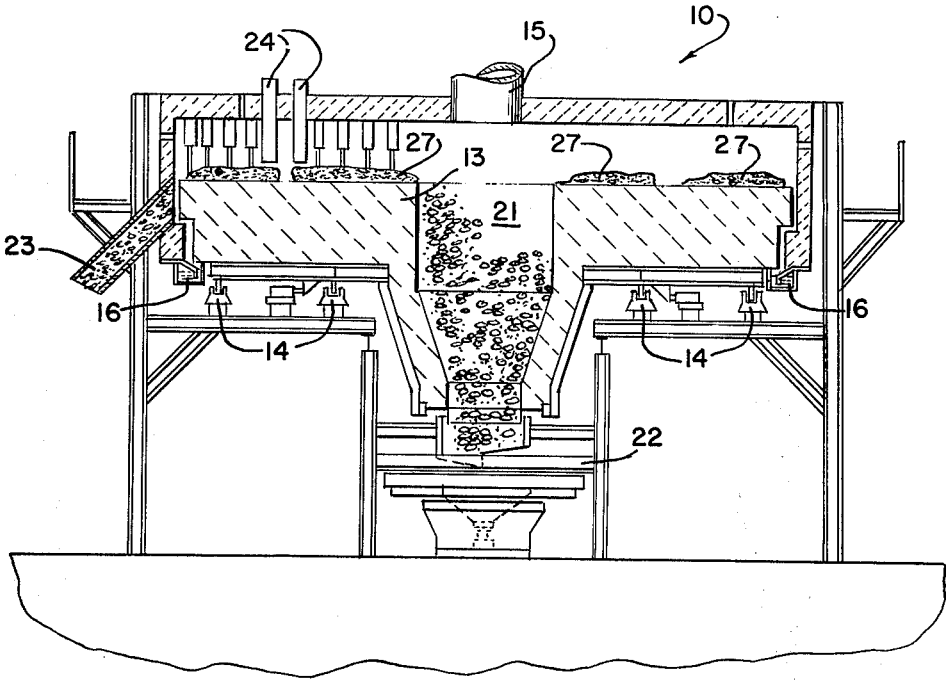
FIG. 2 is a cross sectional view of the enclosure of the present invention, showing a one-piece hearth.
Figure 3:
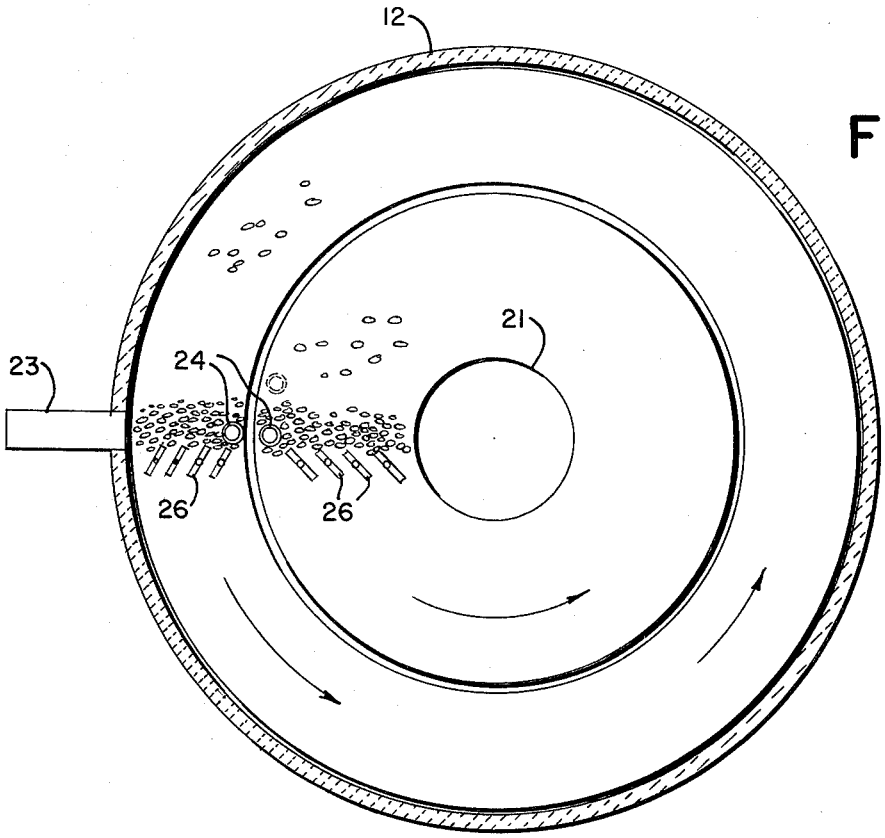
FIG. 3 is a section taken on lines 3—3 of FIG. 1, looking in the direction of the arrows.
Figure 5:
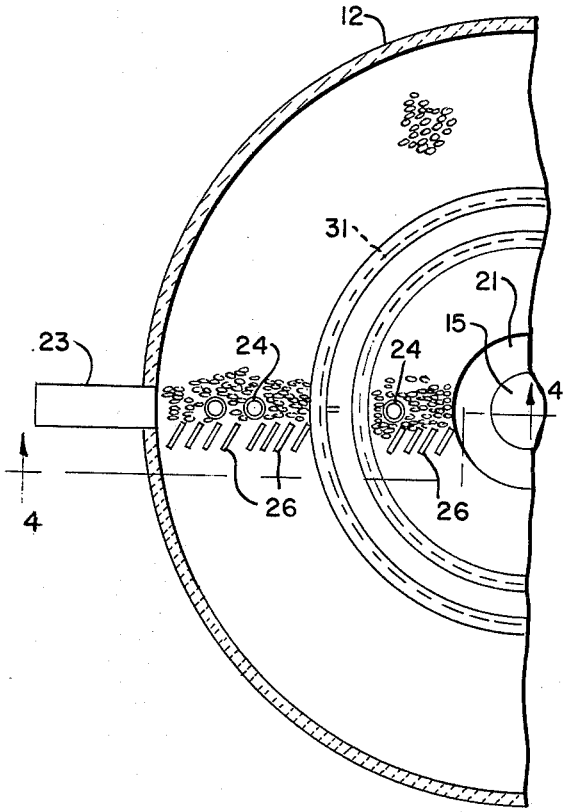
FIG. 5 is a section taken on lines 5—5 of FIG. 4, looking in the direction of the arrows.
Figure 4:
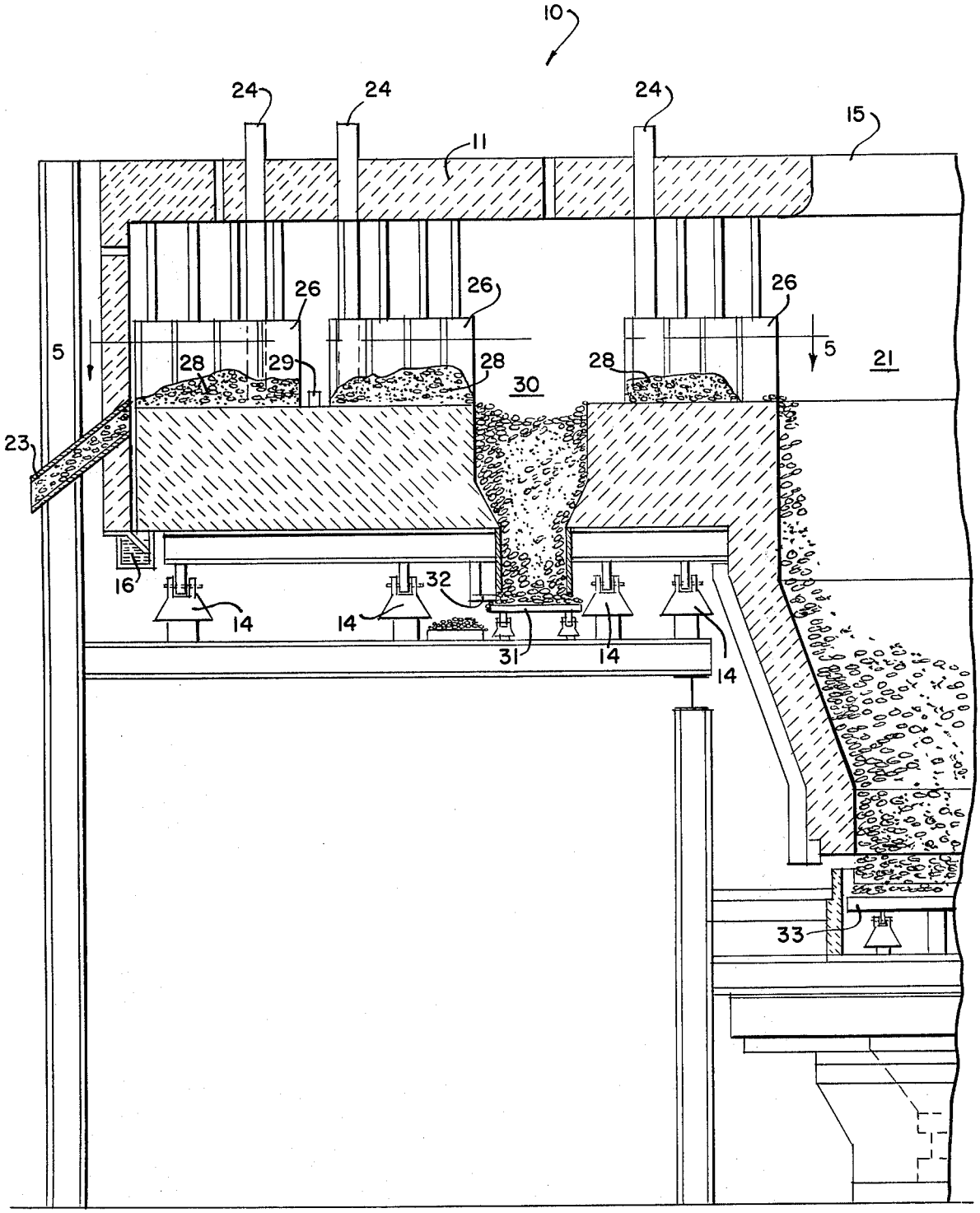
FIG. 4 is an enlarged sectional view showing a modification of the hearth floor.

Referring now more particularly to FIG. 4 of the drawings there is shown therein a modification of the structure of the present invention. The sectional hearth shown in this modification of the invention is designed to receive thereon three separate and spaced apart rows of materials 28. To retain the materials in the rows separated from one another, a baffle 29 can be mounted in any known manner in the floor of the hearth. Chutes 24 extend through the roof of the enclosure in the manner and for the purpose previously described. Sets of rabbles 26 are also roof supported and are adapted to function in the same manner and for the same purpose as previously described with respect to FIGS. 1 and 2. In addition to having a side exit 23 and a central exit 21 there is provided an intermediate exit 30 which extends through the floor of the hearth and leads to a suitable material receiving table 31 mounted for rotation in any known manner and the materials deposited therein are removed from therewithin as by means of a stationary blade 32 which will engage with the materials on the table 31 and direct the same outwardly thereof. A similar rotating table 33 is positioned under the central exit 21. As can be appreicated, the hearths shown in FIGS. 1, 2 and 4 are adapted to be continuously rotated by any known power means when the furnance is in operation.

Figure 9:
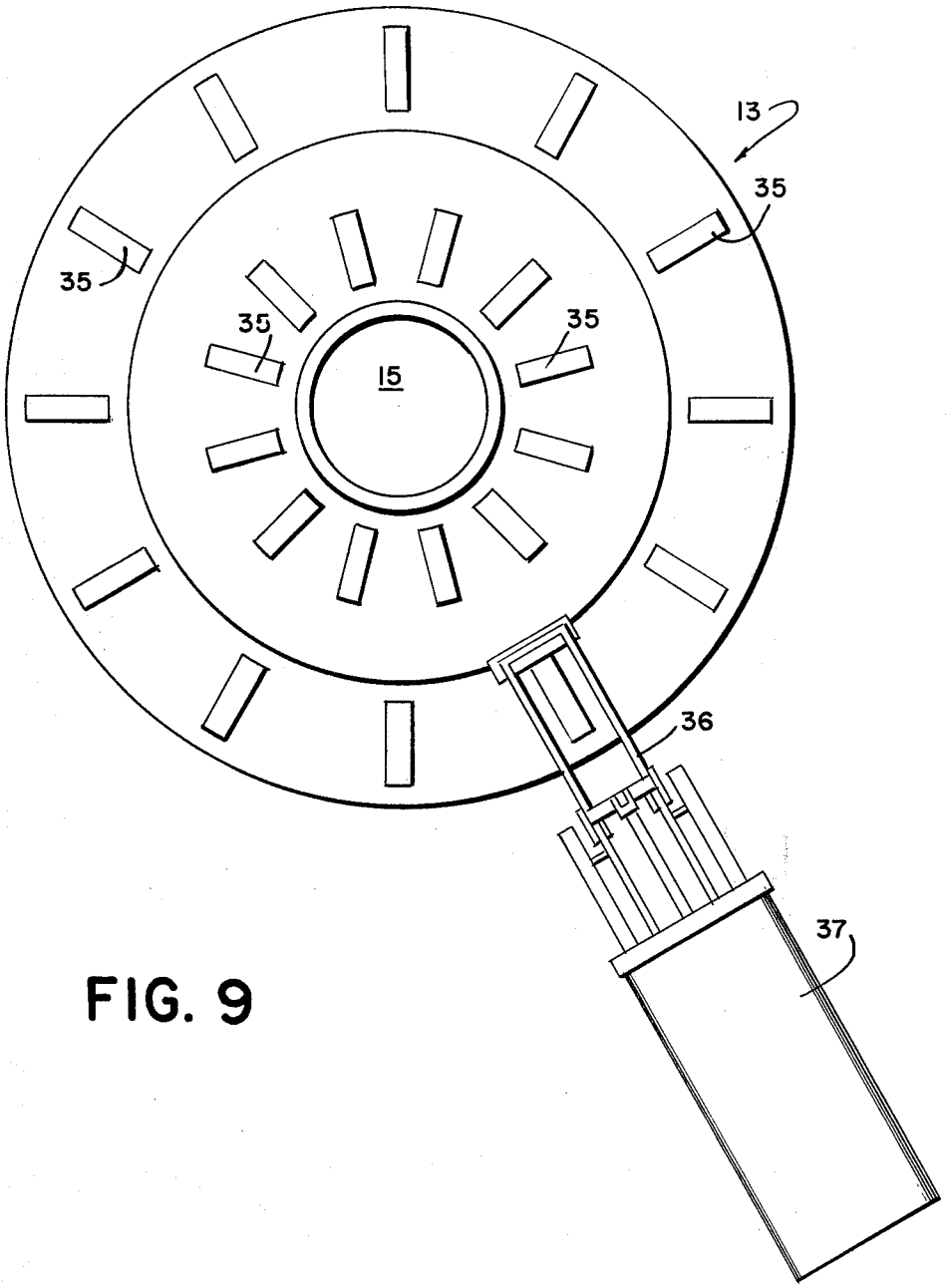
FIG. 9 is a schematic view showing the staggered arrangement of a plurality of concentrically arranged rows of objects placed on a hearth with means for placing and removing the objects on the hearth.

Shown in FIG. 9 of the drawings is a still further modification of the invention. In this modification of the invention the hearth 13 may be of unitary construction such as described previously with respect to FIG. 2 of the drawings or be a sectional hearth such as described with respect to FIG. 1 of the drawings and the same supported for rotation on a suitable framework in the manner described previously. The structure shown in FIG. 9 is adapted particularly for the processing thereon of solid objects such as steel ingots and the like. The objects to be treated are shown at 35 and as shown, the same are arranged in spaced apart concentric rows and the objects in one row are staggered with respect to the objects in the other spaced apart row. A suitable mechanism such as a pusher arm 36 operated in any known manner by the motive power 37 is adapted to be employed for placing the objects on the floor of the hearth or to remove the objects from thereon following their heat treatment within the enclosure, such a mechanism is shown in U.S. Pat. No. 3,410,543 to James A. Scharbrough. The hearth shown in FIG. 9 is rotated in the manner aforesaid but instead of continuously rotating as in the other modifications of the invention previously described, some means is provided to stop the rotation of the hearth when it is desired to load articles or objects onto the hearth or to remove the same from thereon following the heat treatment thereof within the enclosure which houses the hearth. One spaced apart row of objects on the hearth shown in FIG. 9 will contain sufficient volatile matter therein which will be evolved when the objects are subjected to a heat treatment as by the heat generated within the enclosure by the combustion of the evolved volatiles and the oxidant admitted into the enclosure.

Figure 7:
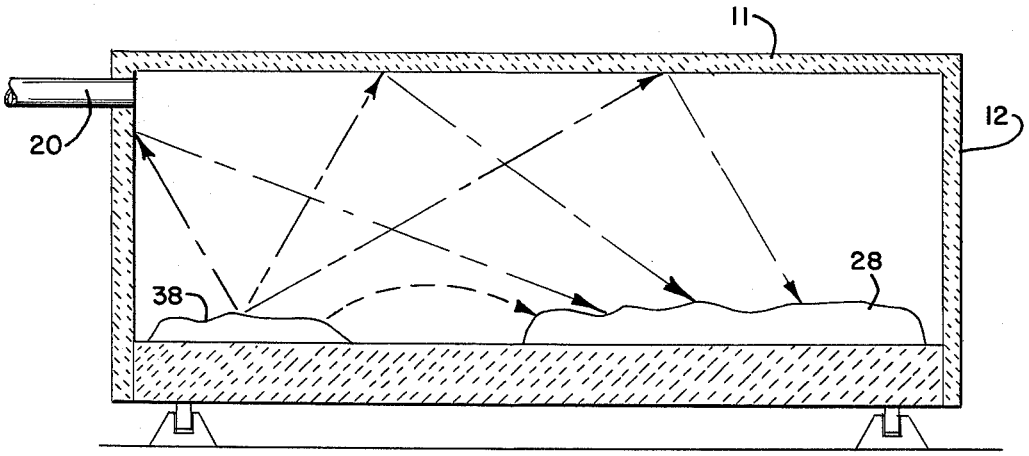
FIG. 7 is a schematic showing the typical lines of heat radiation within the enclosure of the present invention.
Figure 8:
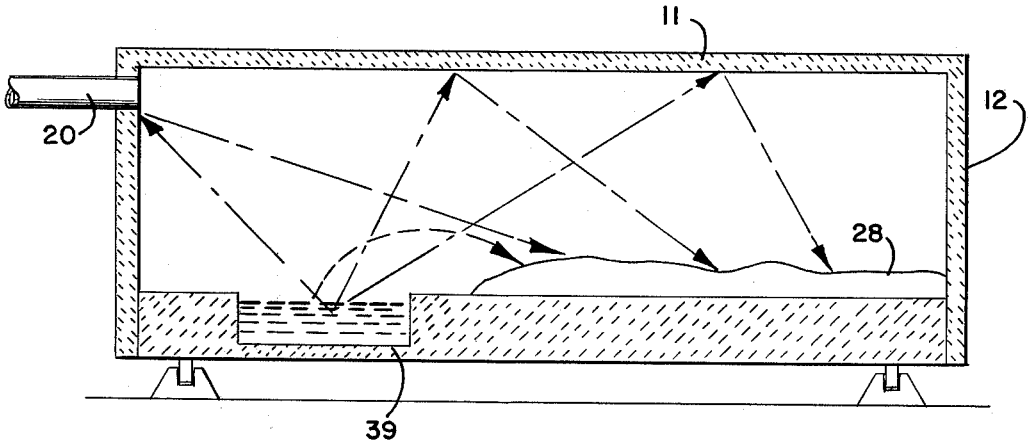
FIG. 8 is a view similar to FIG. 6 showing the recessed area in the floor of the hearth.

The schematics shown in FIGS. 7 and 8 of the drawings illustrate the manner in which the heat generated within the enclosure is transferred from the roof and side walls of the enclosure onto the adjacent spaced apart row of materials on the hearth. In FIG. 7 of the drawings there is shown a row of materials 38 and a spaced apart row of materials 28. The materials 38 are capable of evolving volatiles when exposed to heat and the volatiles rise towards the roof of the enclosure where they will combine with an oxidant such as air or oxygen fed through the air port 20 and combust in that area of the enclosure. The heat created in the upper portion of the enclosure is transferred back onto the materials on the next adjacent concentrically arranged spaced apart row or rows to heat treat the materials on these other rows. In lieu of granular materials capable of evolving volatiles when subjected to heat such as shown in FIG. 7 of the drawings, a circularly arranged recessed area 39 as shown in FIG. 8 of the drawings may be formed in the floor of the circular hearth and a liquid such as oil placed therein and the volatiles evolved thereform are designed to function in the same manner and for the same purpose as previously described with respect to FIG. 7 of the drawings. The arrow lines shown in FIGS. 7 and 8 are illustrative only of the flow path of either heat or mass transferred within the enclosure. Having described the various components of the structures shown in the drawings there will not be set forth the manner of operation thereof.

Figure 6:
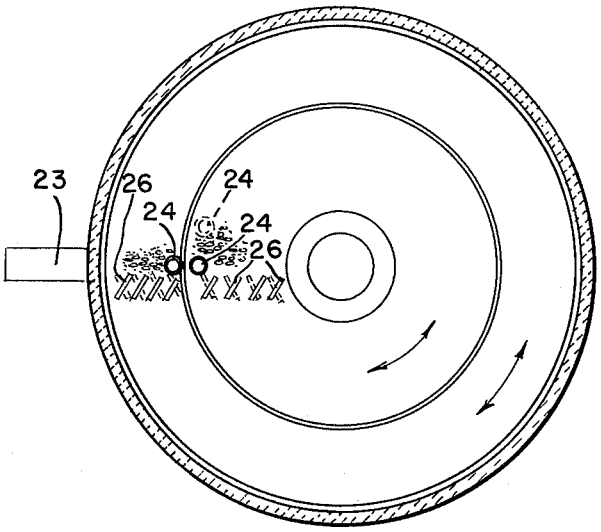
FIG. 6 is a schematic view showing how the hearth sections may be rotated in either the same direction or in opposite directions.

The non-volatile or substantially non-volatile containing materials or substances to be heat treated within the enclosure are delivered onto the surface of the hearth in distinct and separate spaced apart row or rows and a material or substance capable of evolving volatiles when subjected to heat treatment is also fed onto the surface of the hearth, also in a separate and spaced apart row. Initially the enclosure is brought to a working temperature by means of burners mounted in the roof or side walls of the enclosure. The sets of roof mounted rabbles extend to a position closely adjacent to the floor of the hearth and are so disposed within the enclosure as to engage with the row of materials with which they are associated and to turn over the materials while simultaneously advancing the materials toward the outlets. Once the temperature within the enclosure is such that the materials or substances are giving off some of their volatiles the burners may be shut down. The evolved volatiles will mix with an oxidant such as air or oxygen admitted into the upper portion of the enclosure and combust in that area of the enclosure. The heat created by the burning of these evolved volatiles will cause additional volatiles to be evolved from the materials and this process will continue until such time as all or substantially all of the volatiles within the materials will have been combusted. Of course, rotary motion to the hearth will have been imparted and as the hearth rotates the rabbles will engage with the materials which have been deposited on the hearth floor and progressively advance the same to their respective outlets formed in the enclosure. The sectional hearth shown in FIG. 1 of the drawings may be caused to rotate in the same direction but if deemed more beneficial and more efficient, the direction of travel of the hearth sections may be opposite to one another as shown in FIG. 6 of the drawings. The only change that need be done to permit this counter rotation of the hearth sections is the rearrangement of the baffles and the chute as shown in this figure of the drawings. When the hearth sections 17 and 18 are both rotated in a clockwise motion, the chute 24 provided for the inner hearth sections 18 is as shown in full lines in FIG. 6 of the drawings, whereas when the inner hearth is rotated in a counter-clockwise motion, the feed chute 24 is arranged in the roof as shown in dotted lines in this view of the drawings. With respect to the manner of operation of the modification shown in FIG. 9 of the drawings, the objects to be heat treated are loaded onto the hearth by means of a mechanical loader. The objects are arranged in spaced apart rows and in spaced relationship so as to permit for the mechanical loader to function properly. The objects in at least one of the spaced apart rows contain volatiles therein which are evolved when subjected to a heat treatment and once the temperature in the enclosure has reached the desired temperature the process continues as described previously until such time as the objects on the hearth have been properly processed and when this has been accomplished, the treated objects may be removed from on the floor of the hearth and replaced with a new or unprocessed object. As can be appreciated, once the enclosure has reached the desired temperature, the continued evolving of volatiles from the materials containing the same will effect a continuing combustion of the volatiles in the upper portion of the enclosure while retaining a reducing atmosphere about the materials undergoing treatment on the hearth. In the event the volatile evolving substances or objects do not contain sufficient volatiles therein to permit for the efficient operation of the process herein described, additional heat may be added to the enclosure by any suitable means such as burners or the like mounted in the upper portion of the enclosure, preferably in the roof thereof. Also, as can be appreicated and as clearly taught in the Asquini patent referred to above, once the operation of the apparatus has been initiated and the desired temperature attained within the enclosure, the continued operation of the apparatus and process may be carried out on an autogenic basis.

I have illustrated in the drawings a structure capable of processing a plurality of rows of volatile and non-volatile or substantially non-volatile containing substances or objects, and whereas I have designated the outermost row of materials or objects to be the volatile containing materials or objects, it is to be understood that this arrangement of rows may be varied according to varying circumstances and likewise the number of rows of materials or objects may be increased or decreased depending on the nature of the operation of the process. As for example, the volatile containing material may be coal whereas the materials to be heat treated may be lime. Likewise, in the case of heat treating solid objects, the volatile containing material may be in the form of coal with a sufficient amount of volatiles therein to provide for the heat treatment of the solid objects, which can, for example, be steel ingots or the like.

In the foregoing description of the method and apparatus for the heat treatment of separate materials on a traveling hearth I have illustrated and described certain presently preferred embodiments of my invention, it will be understood, however, that this invention may be otherwise embodied within the scope of the following claims.

What is claimed is:

1. The method for the simultaneous heat treatment of spaced apart and concentrically arranged rows of materials deposited on a horizontally disposed hearth mounted for rotation on a vertical axis and which is confined within a substantially air-tight enclosure wherein one concentrically arranged row of materials is composed of a volatile containing material which will evolve volatiles therefrom when subjected to a heat treatment within the said substantially air-tight enclosure and a separate and spaced apart concentrically arranged row of materials composed of a non-volatile or substantially non-volatile containing material is also deposited on the said rotary hearth, retaining said rows of volatile and non-volatile or substantially non-volatile containing materials in separate and spaced apart rows of materials on said horizontally deposited hearth from the time of deposit of said spaced apart rows of materials on said hearth until the removal thereof from on the said hearth, subjecting said rows of volatile and non-volatile or substantially non-volatile containing materials to a heat treatment within said enclosure by feeding an oxidant into the upper portion of the enclosure to there comingle with the volatiles evolved from the concentrically arranged and spaced apart rows of volatile containing material and to combust therewith in that portion of the enclosure, the heat created by the combustion of the evolved volatiles and oxidant being transferred from the roof and side walls of the enclosure on to the next spaced apart row of non-volatile or substantially non-volatile containing material to thus heat treat the same, and following the heat treatment of said non-volatile or substantially non-volatile containing materials on said hearth, the same as well as the volatile containing materials are removed from said hearth through exit openings in said enclosure.

2. The method recited in claim 1 wherein one or more of said material in said spaced apart rows on said hearth is granular.

3. The method recited in claim 1 wherein one or more of said material in said spaced apart rows on said hearth comprises solid objects.

4. An apparatus for the simultaneous heat treatement of volatile and non-volatile or substantially non-volatile containing materials including a substantially air-tight enclosure having a roof and side walls and a horizontally disposed hearth mounted for rotation on a vertical axis and wherein oxidant admission ports are formed in the upper portion of the enclosure, the improvement comprising a plurality of spaced apart sets of roof mounted feed chutes extending to a position closely adjacent the floor of said hearth, a volatile containing material fed on to the floor of said hearth through one of said feed chutes and deposited thereon in a first row, a non-volatile or substantially non-volatile containing material fed on to the floor of the said hearth through another of said chutes and deposited thereon in a row spaced apart from and concentric with said first row of materials, said spaced apart rows of materials retained in spaced apart rows of materials from the time of deposit of said materials on the said hearth until the removal thereof from on the said hearth means for removing each of said spaced apart rows of materials from the floor of the hearth following the heat treatment of the said materials caused by the combustion of the evolved volatiles from the volatile containing materials and the oxidant admitted into the enclosure through the said ports, said means comprising roof mounted rabbles engaging said rows of materials and directing the same to exit openings formed in said enclosure.

5. The structure recited in claim 4 wherein exit ports for the removal of the heat treated materials from onto the hearth are provided peripherally and centrally of said hearth.

6. An apparatus for the simultaneous heat treatment therein of volatile and non-volatile or substantially non-volatile containing material including a substantially air-tight enclosure having a roof, side walls and a horizontally disposed hearth mounted for rotation on a vertical axis and wherein oxidant admission ports are formed in the upper portion of the enclosure, the improvement comprising, a plurality of spaced apart feed chutes and rabbles mounted in the roof of the enclosure and extending to a position closely adjacent the floor of the said hearth, a volatile containing material fed onto the floor of said hearth through one of said feed chutes and forming a first row of volatile containing material on the floor of said hearth whereas the other feed chutes deliver a non-volatile or substantially non-volatile material on the floor of the hearth and depositing the same in a spaced apart and concentric row from said first row, each said sets of rabbles engaging with one of said spaced apart and concentric rows of materials to turn over the materials on the hearth and to simultaneously progressively advance the same towards discharge ports formed in the said enclosure.

7. The structure recited in claim 6 wherein discharge ports for the materials on the hearth are provided intermediate the peripheral and central discharge outlets.

8. The structure recited in claim 6 wherein spaced apart feed chutes are mounted in the roof of the enclosure and sets of rabbles are mounted in the roof of the enclosure, one set of rabbles engaging with the row of volatile containing material and the other set of rabbles engaging with the row of non-volatile or substantially non-volatile containing materials to turn over said materials and simultaneously progressively advancing each said sets of rows of materials to discharge outlets formed in the said enclosure.

9. The structure recited in claim 4 wherein said volatile containing material comprises granular substances.

10. The structure recited in claim 4 wherein said volatile containing material comprises a liquid fuel.

11. The structure recited in claim 4 wherein said volatile containing material comprises solid objects.

* * * * *